US009776439B2

(12) United States Patent
Sanaei et al.

(10) Patent No.: US 9,776,439 B2
(45) Date of Patent: Oct. 3, 2017

(54) BELT ASSEMBLY FOR HIGH-SPEED INKJET PRINTING

(71) Applicant: Memjet Technology Ltd., Dublin (IE)

(72) Inventors: Kianoush Mir Sanaei, San Diego, CA (US); Reza Moghaddasian, San Diego, CA (US); Christopher Hibbard, North Ryde (AU)

(73) Assignee: Memjet Technology Limited (IE)

( * ) Notice: Subject to any disclaimer, the term of this patent is extended or adjusted under 35 U.S.C. 154(b) by 0 days.

(21) Appl. No.: 15/220,242

(22) Filed: Jul. 26, 2016

(65) Prior Publication Data

US 2017/0043598 A1 Feb. 16, 2017

Related U.S. Application Data

(60) Provisional application No. 62/204,211, filed on Aug. 12, 2015.

(51) Int. Cl.

| | |
|---|---|
| ***B41J 15/16*** | (2006.01) |
| ***B41J 2/155*** | (2006.01) |
| ***B41J 11/00*** | (2006.01) |
| ***B41J 11/08*** | (2006.01) |
| ***B41J 2/01*** | (2006.01) |
| ***B41J 25/304*** | (2006.01) |
| *B41J 2/165* | (2006.01) |
| *B41J 11/20* | (2006.01) |

(52) U.S. Cl.

CPC ..... *B41J 15/16* (2013.01); *B41J 2/01* (2013.01); *B41J 2/155* (2013.01); *B41J 2/16508* (2013.01); *B41J 2/16585* (2013.01); *B41J 11/007* (2013.01); *B41J 11/0085* (2013.01); *B41J 11/08* (2013.01); *B41J 25/304* (2013.01); *B41J 2/16535* (2013.01); *B41J 11/20* (2013.01); *B41J 2002/16591* (2013.01)

(58) Field of Classification Search

CPC ..... B41J 11/006; B41J 11/0065; B41J 11/007; B41J 13/0054; B41J 13/103; B41J 13/106; B41J 13/12; B41J 13/18; B41J 13/223; B41J 13/226; B41J 13/24; B41J 13/32; B41J 15/00; B41J 15/16; B41J 2/01

See application file for complete search history.

(56) References Cited

U.S. PATENT DOCUMENTS

| | | | |
|---|---|---|---|
| 6,328,439 | B1 | 12/2001 | Rhodes |
| 6,698,878 | B1 | 3/2004 | Roche |
| 2008/0218576 | A1 | 9/2008 | Phillips |
| 2011/0157286 | A1 | 6/2011 | Ikegami |

FOREIGN PATENT DOCUMENTS

| | | | |
|---|---|---|---|
| WO | 2015047384 | A1 | 4/2015 |

OTHER PUBLICATIONS

International Search Report; PCT/EP2016/068596, Mailed Oct. 12, 2016.

*Primary Examiner* — Kristal Feggins
(74) *Attorney, Agent, or Firm* — Cooley LLP

(57) ABSTRACT

A printer includes: a printhead assembly having a print zone and a belt assembly for feeding print media past the print zone in a media feed direction. The belt assembly includes: an endless belt tensioned between a first roller upstream of the print zone and a second roller downstream of the print zone; a drive mechanism for moving the endless belt in the media feed direction; and a fixed platen positioned in the print zone. The endless belt is guided around and below the fixed platen.

9 Claims, 3 Drawing Sheets

BELT ASSEMBLY FOR HIGH-SPEED INKJET PRINTING

CROSS-REFERENCE TO RELATED APPLICATIONS

This application claims priority to U.S. provisional application Ser. No. 62/204,211, filed Aug. 12, 2015, entitled "BELT ASSEMBLY FOR HIGH-SPEED INKJET PRINTING," which is hereby incorporated herein by reference in its entirety.

FIELD OF THE INVENTION

This invention relates to a belt assembly for a printer. It has been developed primarily to provide a media feed mechanism suitable for high-speed inkjet printing.

BACKGROUND OF THE INVENTION

The Applicant has developed a range of Memjet® inkjet printers as described in, for example, WO2011/143700, WO2011/143699 and WO2009/089567, the contents of which are herein incorporated by reference. Memjet® printers employ a stationary printhead in combination with a feed mechanism which feeds print media past the printhead in a single pass. Memjet® printers therefore provide much higher printing speeds than conventional scanning inkjet printers.

High-speed single-pass inkjet printing requires accurate media handling, especially in the print zone of the printhead, in order to provide acceptable print quality. For relatively narrow print zones (e.g. A4 size or narrower), a system of entry and exit rollers in combination with a fixed media platen generally provides sufficient stability in the print zone (see, for example, U.S. Pat. No. 8,523,316, the contents of which are herein incorporated by reference). However, for wider media widths and/or faster print speeds, more complex media feed mechanisms are required to provide acceptable print quality. For example, U.S. Pat. No. 8,540,361 describes a feed mechanism suitable for wideformat printing comprising a combination of a fixed vacuum platen, an upstream drive roller and a downstream vacuum belt mechanism.

Vacuum belt mechanisms are an attractive means for moving print media at high speeds through a print zone. Various vacuum belt mechanisms for high-speed printing are described in, for example, US 2007/0247505, US 2007/0035605, US 2008/0218576, U.S. Pat. No. 6,328,439, U.S. Pat. No. 6,698,878 and WO02/78958. Referring to FIGS. 1A and 1B, prior art vacuum belt mechanisms typically comprise an endless belt 1 tensioned between a first roller 3 positioned upstream of a print zone 5 and a second roller 7 positioned downstream of the print zone. A printhead assembly 9 is positioned over an upper surface of the belt 1 while a vacuum blower 11 is positioned below the belt for suctioning print media onto the upper surface. The printhead assembly 9 is liftable away from the belt to allow intervention from a maintenance station 13, when required (FIG. 2A). Likewise, the entire vacuum belt mechanism 10 may be movable away from printhead assembly 9 to facilitate clearance of paper jams.

A problem with prior art vacuum belt mechanisms, such as the mechanism described in connection with FIG. 1A, is that the belt may become fouled with ink. Ink mist generated in the print zone during printing is drawn towards the belt by the vacuum blower, thereby fouling the belt and, consequently, fouling paper in contact with the belt. Furthermore, it is desirable for inkjet printheads to spit ink regularly so as to avoid nozzles becoming clogged with a plug of viscous ink. Typically, inkjet printheads perform a number of inter-page spits so as to reduce the frequency of maintenance interventions. However, endless belts are not amenable to inter-page spitting due to ink fouling.

It would be desirable to provide a printer having a belt assembly suitable for high-speed inkjet printing.

SUMMARY OF THE INVENTION

The present invention provides a printer comprising:

a printhead assembly having a print zone;

a belt assembly for feeding print media past the print zone in a media feed direction, the belt assembly comprising:

an endless belt tensioned between a first roller upstream of the print zone and a second roller downstream of the print zone;

a drive mechanism for moving the endless belt in the media feed direction; and a fixed platen positioned in the print zone, wherein the endless belt is guided around and below the fixed platen.

The printer of the present invention enjoys the advantages of high-speed media feeding using an endless belt, whilst advantageously avoiding the usual problems of ink fouling the belt.

Preferably, the fixed platen comprises a spittoon for receiving ink. The spittoon advantageously collects ink spitted from the printhead, such as inter-page spits which are used to maintain healthy nozzles during a print job.

Preferably, the printhead assembly comprises one or more fixed inkjet printheads configured for singe-pass printing.

Preferably, the printer further comprises a printhead lift mechanism for moving the printhead assembly between a printing position and a maintenance position.

Preferably, the printer further comprises a maintenance station for capping and/or wiping the printhead in the maintenance position.

Preferably, the printer further comprises a belt lift mechanism for moving the belt assembly towards and away from the printhead assembly.

Preferably, the endless belt comprises an apertured belt and the belt assembly further comprises at least one vacuum blower for suctioning print media onto a surface of the apertured belt.

Preferably, the belt assembly comprises one or more rollers for guiding the endless belt below the fixed platen.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1A:
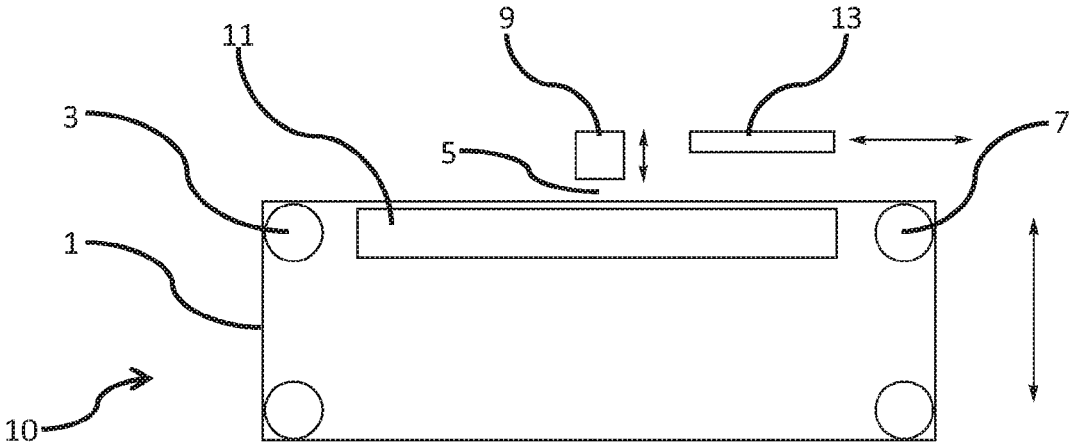
FIG. 1A (PRIOR ART)
FIG. 1A is a schematic side view of a prior art vacuum belt assembly in a printing position.
Figure 1B:
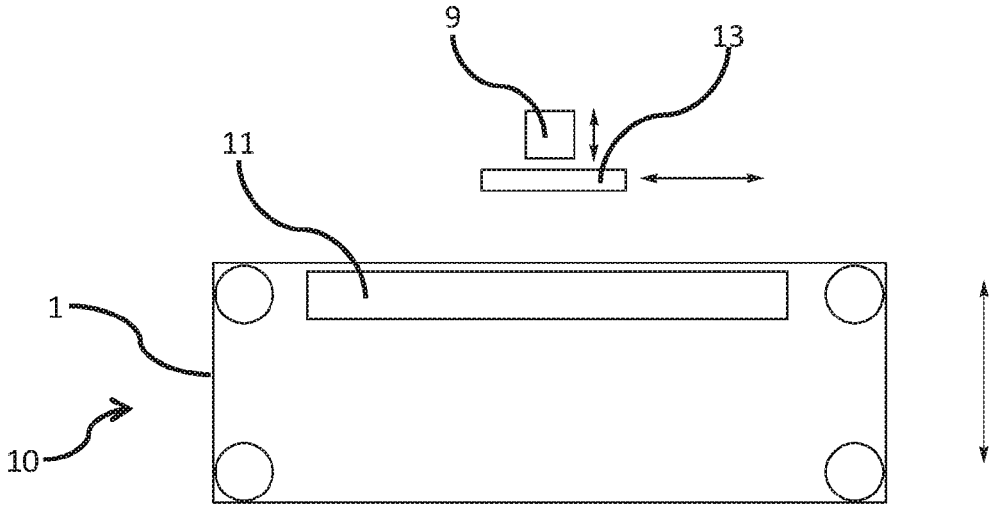
FIG. 1B (PRIOR ART)
FIG. 1B shows the prior art vacuum belt assembly of FIG. 1A in a maintenance position.
Figure 2A:
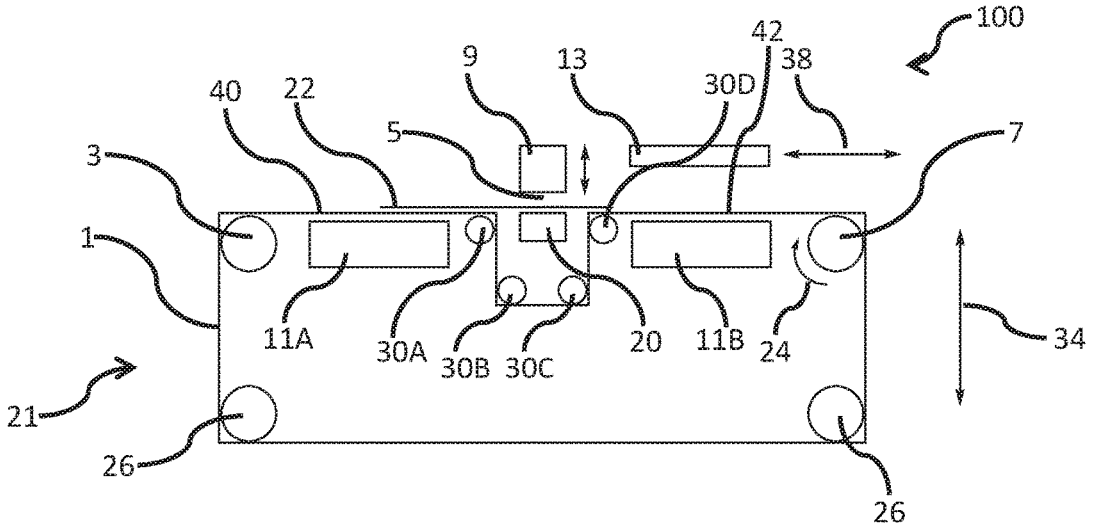
FIG. 2A is a schematic side view of a printer according to the present invention in a printing position.
Figure 2B:
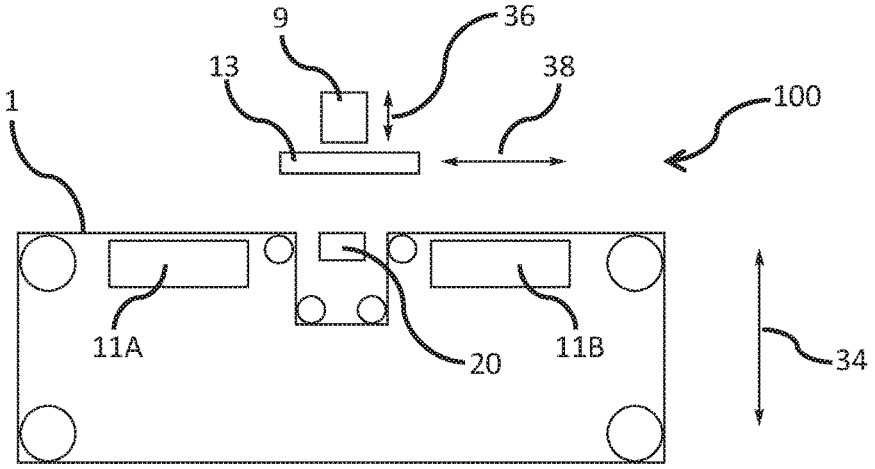
FIG. 2B shows the printer of FIG. 2A in a maintenance position.

Referring to FIGS. 2A and 2B, there is shown a printer 100 comprising a belt assembly 21 and a printhead assembly 9, in accordance with the present invention. The printhead assembly 9 has an associated print zone 5 which is defined by the printable area of the printhead assembly. The printhead assembly 9 may be comprised of one or more fixed inkjet printheads, each of which may be comprised of a plurality of individual printhead chips. By way of example, U.S. Pat. No. 8,540,361 (the contents of which are incorporated herein by reference) describes a printhead assembly comprising five staggered printheads, each printhead comprising eleven printhead chips butted in a row. Alternatively, the printhead assembly 9 may comprise a single printhead, as described in U.S. Pat. No. 8,523,316. Alternatively, the printhead assembly 9 may comprise a pair of overlapping printheads.

The printhead assembly 9 is positioned over a fixed platen 20 positioned in the print zone 5 of the printhead assembly. An endless belt 1 feeds print media (e.g. paper 22) from an upstream side of the printhead assembly 9 to a downstream side. The endless belt 1 is tensioned between a first roller 3 positioned upstream of the printhead assembly 9 and a second roller 7 positioned downstream of the printhead assembly. The first roller 3 is an idler roller while the second roller 7 is a drive roller operatively connected to a drive mechanism indicated schematically by arrow 24. In the embodiment shown in FIG. 2A, additional rollers 26 guide the endless belt 1 around a loop. It will be appreciated that the number and position of additional rollers 26 is not particularly important to the present invention.

Figure 4:
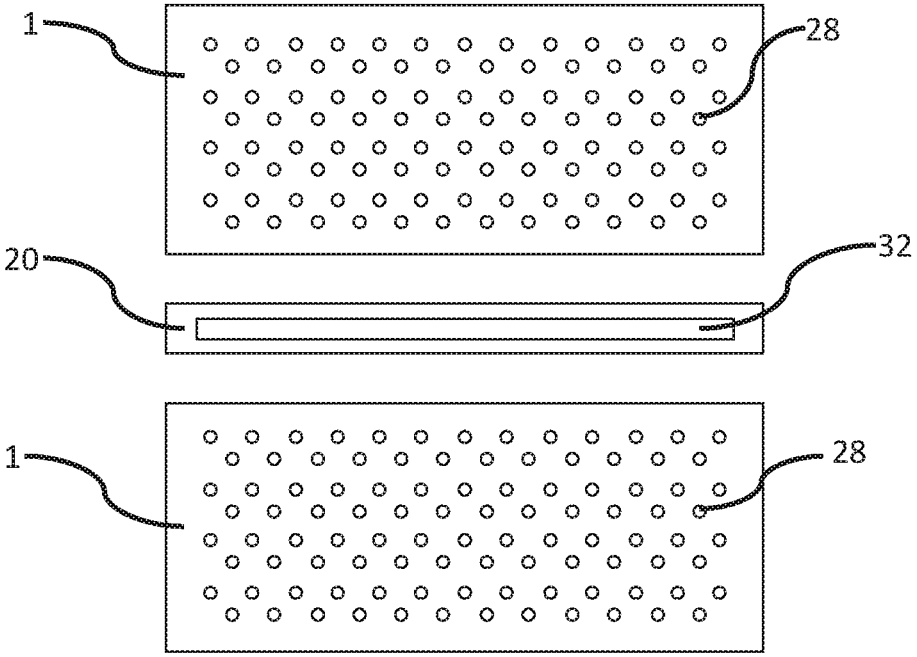
FIG. 4 is a schematic plan view of an apertured belt and fixed platen.

An upstream vacuum blower 11A and a downstream vacuum blower 11B impart a suction force onto the belt 1 so as to draw the paper 22 onto an upper surface of the belt. As shown in FIG. 4, the belt 1 has a plurality of apertures 28 so that the paper 22 experiences a suction force through the belt.

Figure 3:
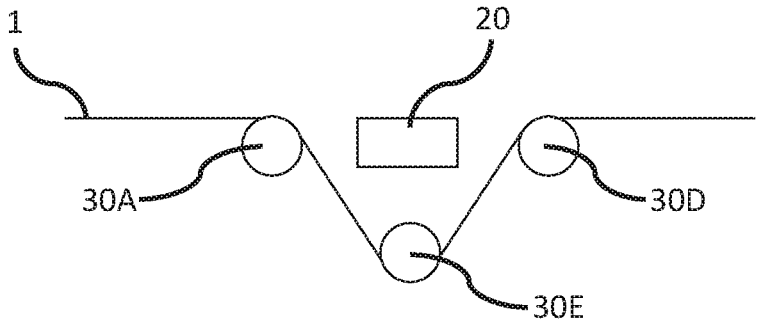
FIG. 3 shows an alternative pathway of a belt around a fixed platen.

A plurality of guide rollers 30A-D are positioned to guide the endless belt 1 in a path around and below the fixed platen 20. Thus, the endless belt 1 does not move through the print zone 5 and the sheet of paper 22 is supported by the fixed platen 20 when moving through the print zone. The number and position of guide rollers 30 and the precise path of the endless belt 1 around the fixed platen 20 is not particularly important. For example, by way of an alternative arrangement, the endless belt 1 may follow a generally triangular path around the fixed platen 20 with one central guide roller 30E positioned below the fixed platen (FIG. 3). These and other guide roller arrangements will be readily apparent to the person skilled in the art.

Turning to FIG. 4, the fixed platen 20 comprises a spittoon 32 in the form of an opening positioned opposite the print zone 5. The spittoon 32 is positioned to collect ink spitted from the printhead assembly 9, such as inter-page spits which are used to maintain nozzle health during print jobs. The spittoon 32 may comprise an absorbent material and/or a suitable arrangement for wicking ink away from the fixed platen 20. Alternatively or additionally, the spittoon 32 may be connected to a vacuum source (not shown). For example, the fixed platen 20 may be in the form of a vacuum platen to further assist with paper control through the print zone 5.

Referring again to FIG. 2A, the entire belt assembly 21, including the fixed platen 20 and endless belt 1, is operatively connected to a belt lift mechanism, which is schematically represented by arrow 34. The belt lift mechanism 34 moves the belt assembly 21 towards and away from the printhead assembly 9 to facilitate clearance of paper jams. Suitable sensors (not shown) may be provided for detecting paper jams and actuating the belt lift mechanism 34 to lower the belt assembly 21 when a paper jam is detected.

Similarly, the printhead assembly 9 is operatively connected to a printhead lift mechanism, which is schematically represented by arrow 36. The printhead lift mechanism 36 moves the printhead assembly 9 towards and away from the fixed platen 20 and belt 1 to enable maintenance of the printhead assembly by the maintenance station 13. The maintenance station 13 is operatively connected to a translation mechanism 38 for slidably moving the maintenance station towards and away from the printhead assembly 9. U.S. Pat. No. 9,061,531, the contents of which are incorporated herein by reference, describes a printhead lift mechanism and sliding maintenance station suitable for maintaining a fixed inkjet printhead. Typically, the maintenance station 13 comprises a capping module and a wiping module, as described in U.S. Pat. No. 9,061,531.

FIG. 2B shows the printer 100 in a maintenance position whereby the printhead assembly 9 is lifted away from the fixed platen 20 and belt 1 by the printhead lift mechanism 36, and the maintenance station 13 has slid beneath the printhead assembly 9 by operation of the translation mechanism 38. The printhead(s) may be capped or wiped in this maintenance position.

FIG. 2A shows the printer 100 in a printing position. The endless belt 1 is driven at constant speed by the drive mechanism 24 to convey the paper 22 in the media feed direction. The paper 22 is initially fed onto an upper surface of an upstream portion 40 of the belt 1 by a suitable paper picker (not shown). The paper 22 is suctioned onto the belt 1 by the upstream vacuum blower 11A and moved towards the print zone 5. The paper 22 is then transferred from the belt 1 onto the fixed platen 20 to move through the print zone 5. Finally, the paper 22 is transferred from the fixed platen 20 onto a downstream portion 42 of the belt 1 and moved away from the print zone 5. The endless belt 1 and vacuum blowers 11A and 11B enable smooth transportation of the paper 22 at constant speed with excellent control of paper movement. Moreover, diverting the endless belt 1 around and below the fixed platen 20 in the print zone 5 avoids fouling of the belt by ink mist or spitted ink. The spittoon 32 in the fixed platen 20 collects any non-printing ink, which can be readily removed without contaminating the belt 1.

It will, of course, be appreciated that the present invention has been described by way of example only and that modifications of detail may be made within the scope of the invention, which is defined in the accompanying claims.

The invention claimed is:

1. A printer comprising:

a printhead assembly having a print zone;

a belt assembly for feeding print media past the print zone in a media feed direction, the belt assembly comprising:

an endless belt tensioned between a first roller upstream of the print zone and a second roller downstream of the print zone;

a drive mechanism for moving the endless belt in the media feed direction; and a fixed platen positioned in the print zone, wherein the endless belt is guided around and below the fixed platen, such that the endless belt does not move through the print zone and the print media is supported only by the fixed platen when moving through the print zone.

2. The printer of claim 1, wherein the printhead assembly comprises one or more fixed inkjet printheads configured for single-pass printing.

3. The printer of claim 1, further comprising a printhead lift mechanism for moving the printhead assembly between a printing position and a maintenance position.

4. The printer of claim 2, further comprising a maintenance station for capping and/or wiping the printhead in the maintenance position.

5. The printer of claim 1, further comprising a belt lift mechanism for moving the belt assembly towards and away from the printhead assembly.

6. The printer of claim 1, wherein the belt assembly further comprises at least one vacuum blower for suctioning print media onto a surface of the belt.

7. The printer of claim 6, wherein the endless belt is an apertured belt.

8. The printer of claim 1, wherein the fixed platen comprises a spittoon for receiving ink.

9. The printer of claim 1, wherein the belt assembly comprises one or more guide rollers for guiding the endless belt below the fixed platen.

* * * * *